United States Patent [19]

Pichl

[11] 4,033,282

[45] July 5, 1977

[54] HOUSING FOR OUTBOARD MOTORS

[76] Inventor: Heinz Pichl, Bergfallsvagen 3, Uppsala 75256, Sweden

[22] Filed: Sept. 30, 1975

[21] Appl. No.: 618,118

[30] Foreign Application Priority Data

Oct. 2, 1974 Sweden ..... 7412395

[52] U.S. Cl. ..... 115/17; 115/73; 115/75; 123/41.47; 123/195 P

[51] Int. Cl.[2] ..... B63H 21/26

[58] Field of Search ..... 115/17, 18 R, 18 A, 115/18 B, .5 E, .5 HC, 34 R; 123/195 P, 41.47

[56] References Cited

UNITED STATES PATENTS

| | | | |
|---|---|---|---|
| 2,209,301 | 7/1940 | Johnson et al. | 123/195 P |
| 2,357,942 | 8/1944 | Farr | 123/195 P |
| 2,507,034 | 5/1950 | Martin | 115/17 |
| 2,609,782 | 9/1952 | Kiekhaefer | 115/17 |
| 2,644,434 | 7/1953 | Watkins | 123/41.47 |
| 2,718,792 | 9/1955 | Kiekhaefer | 115/34 R |
| 3,195,521 | 7/1965 | Larsen | 115/17 X |
| 3,431,882 | 3/1969 | Irgens | 115/17 |
| 3,520,270 | 7/1970 | Miller | 115/17 |

OTHER PUBLICATIONS

Beadle, John D., *Castings*, Hampshire UK, Macmillan Press, Chapters 10 and 11, pp. 93–107.

*Primary Examiner*—Trygve M. Blix
*Assistant Examiner*—Sherman D. Basinger
*Attorney, Agent, or Firm*—George H. Baldwin; Arthur G. Yeager

[57] ABSTRACT

A drive shaft housing for an outboard power leg adapted for attachment to a boat. Inside the housing there are cavities for a cooling water pump and its drive shaft as well as a cavity for a gear with a drive shaft between the gear and the propeller shaft. The housing is die cast in one single piece in which the drive shaft cavity opens upwards and passes into the downwards opening cavity for the cooling water pump.

12 Claims, 8 Drawing Figures

HOUSING FOR OUTBOARD MOTORS

Figure 1:
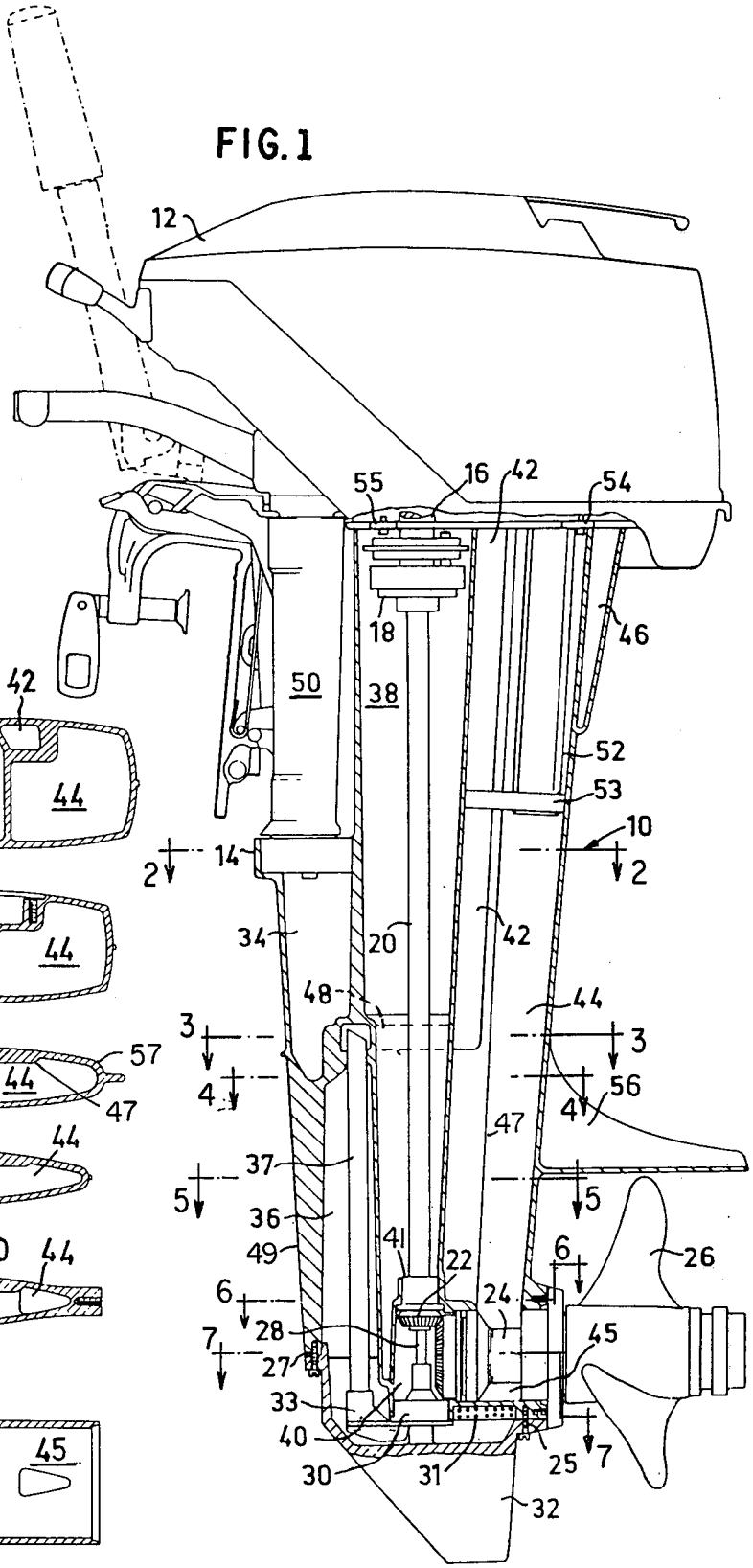
Figure 2:
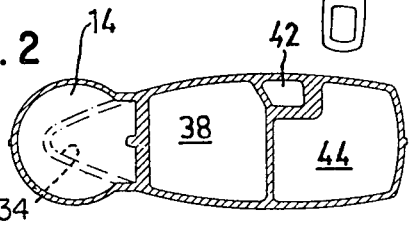
Figure 3:
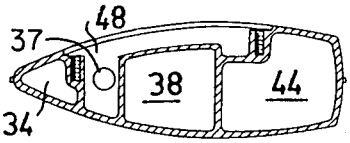
Figure 4:
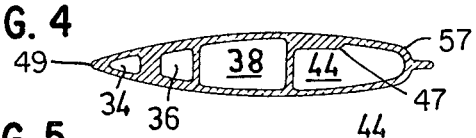
Figure 5:
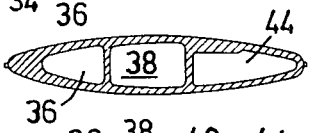
Figure 6:
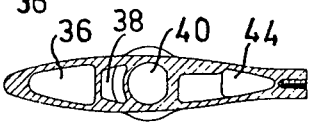
Figure 7:
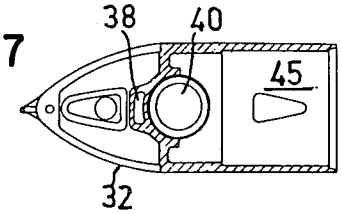

The present invention relates to a drive shaft housing for an outboard motor.

The development of drive shaft housings for outboard motors has only slowly and hesitatingly followed industrial processes which would have been obvious in other connections. Boat building and devices for powering boats have always tended towards conventionalism rather than towards innovation. Thus even housings from the market's leading producers of outboard motors are products of old-fashioned thinking and of the application of outmoded techniques. This implies, briefly, that the housings in today's outboard motors have poorer function, higher complexity and higher cost than is necessary. The purpose of the present invention is to achieve a housing, particularly for outboard motors, which — better than known housing — embraces essential functions, is simpler in its construction and thereby less expensive to produce in a process adapted to construction from materials such as aluminium and plastics, which provides better protection to the components in the housing, which is simpler to assemble and, finally, is considerably cheaper to produce.

A housing normally has the following functions. (1) It must transmit the motor torque and power to the propeller, generally via an angular drive and a so-called reversing gear for reversing the direction of rotation of the propeller. (2) In water-cooled motors the housing must include ports for in- and outgoing cooling water and a cooling water pump. (3) The housing must include an exhaust port for releasing the motor exhaust gas below the surface of the water. (4) The housing must protect the propeller and propeller shaft from damage in at least moderate groundings. (5) The housing supports the weight of the motor and, via a turning bracket, transmits the resulting force of gravity and propulsion to the hull.

Known housings utilize various solutions in construction to meet these requirements. A common arrangement is that the drive shaft at the upper end of the housing drives an intermediate shaft which at the lower housing end, via an angular drive, drives one of two displaceably mounted angular drives located at the propeller shaft, the one providing motion forward and the other reverse motion through the reversing of the rotation of the propeller. The angular drive with reversing gear is commonly also a reducing gear and, in its simple version, provides equal propeller speed forward and in reverse. The reversing takes place by means of a dog or fork which displaces the two angular drives along the propeller shaft and the movement of the gear shift bar is transmitted from the motor control section through a linkage or, optionally, hydraulically straight through the various parts of the housing. The drive shaft also drives a shaft for the cooling water pump via the upper drive which pump, primarily because of space demands for the reversing gear at the bottom of the housing, is located in a space in the housing above the reversing gear.

The common material for housings is cast aluminium. Because of the relatively complex inner shape resulting from the arrangement of the various components within the housing, the housing is commonly cast in moulds having sand cores. Moreover, in known housings it is difficult or impossible to execute the casting in one piece and the housing is therefore executed in an upper section which serves as the motor mounting and upper gear housing, an intermediate section for power transmission and suspension, and a lower section including the cooling water pump, the reversing gear drive with coupling means and propeller shaft journalling. In addition, there is a propeller-protecting fin or skeg. The three housing sections and the fin are connected with as many bolt joints.

Obviously, this type of construction entails a number of costly working steps. Apart from the fin, which as an expendible part should be easily replaceable, manufacturing requires three molds, each having a number of core members which must, in turn, be shaped and carefully placed and, after casting, trimmed and cleaned out. Finally the end surfaces of the three sections must be processed with methods for removing metal cuttings and holes drilled, reamed, and possibly tapped for the bolt joints.

The majority of these working steps is eliminated with the present invention of a housing which essentially can be produced in a single piece using a single die-casting operation in a mold having mold cores which can be removed in the longitudinal direction of the housing. The casting material may be an aluminium alloy or a plastic material and the casting produces such dimensional accuracy and surface fineness that little or no after-treatment is required.

The invention is made possible by a new device for transmitting the motor torque and power to the propeller and water pump according to a separate patent application.

Figure 8:
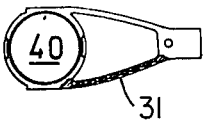

The invention is described below with reference to the accompanying drawing, in which:

FIG. 1 is a side elevation, partially broken away and in section, of an outboard motor in accord with my invention;

FIGS. 2, 3, 4, 5, 6 and 7 are sectional views taken, respectively, along lines 2—2, 3—3, 4—4, 5—5, 6—6 and 7—7 of FIG. 1; and FIG. 8 is a bottom view with the skeg member removed.

In the drawings the housing as a unit is designated 10. At the upper end of the housing or leg member 10 a motor is detachably mounted with bolts inside a casing 12. The motor drive shaft 16 via a reversible gear unit 18 drives an intermediate shaft 20 which, via an angular drive 22 with reduction of propeller revolutions, drives a propeller shaft 24 on which a propeller 26 is detachably mounted. A rotatable shaft 28 runs through the hollow shaft 20 for driving a water pump 30 whose ports for the supply and exhaust of water are downwards covered and protected by a skeg 32 which is detachably connected to the housing 10.

The housing 10 is thus executed in a single piece of die-cast material enclosing a number of cavities which run substantially in the longitudinal direction of the housing and which continuously or gradually taper from the opening at each housing end to allow unimpeded removal of the respective cavity casting cores after the casting material has hardened.

Starting from the left of the embodiment shown in the drawing, inwardly of the housing and along the leading edge 49 thereof, is seen a cavity 34 opening upwards and located about one-third of the housing length from the mounting plane of the housing to the motor. At the upper end the cavity 34 is abruptly widened into a cylindrical section 14 into which, when the housing is used, is pressed a rubber insert having a center metal bushing for a pin which is rotatable therein, which pin extends downwards from a pillar 50 connected to the hull mounting. Below and immediately behind the port 34 a cavity 36 opens at the lower end of the housing, the casting material in front of the cavity 36 being amply dimensioned so as to be able to resist impact and bending stress in the event of grounding with the housing. The cavity 36 includes a part of the inlet line for cooling water from the pump 30 to the motor. In view of the serious consequences of cooling interruption in a rupture of the wall in the cavity 36, a special cooling water line of, for example, a plastic tube 37 is provided in the cavity 36 having sufficient press sealing between the plastic tube 37 and a cylindrical upper section in the cavity 36 adapted for the plastic tube 37. From the plastic tube 37, which may be obliquely cut off, the cooling water flows towards the motor through a horizontal transverse channel 48 which runs on one of the outer sides, e.g. the starboard side, of an upwardly opening middle channel 38. At the lower wall of the channel 48 the cross section of the housing or casing in the present embodiment increases abruptly upwards.

The cooling water could, of course, be led from the pump at the lower end of the housing to the motor in another way, but the chosen path through the transverse channel 48 affords particular advantages in the production of the casting. The transverse channel 48 is open to starboard, for example, along its entire length in the casting and is ultimately closed with a cover. The outer edge surface of the channel (which afterwards forms three of the inner sides of the channel 48) is cast towards a shoulder which projects inwards from the starboard stock mold. Guides in this shoulder center and support during casting the casting cores for the channels 34 and 36 and the core for a channel 42 which rises from the stern end of the channel 48. The cross section of the cooling water channel 42 is comparable to that of the plastic tube 37. Channel 42 and its wall of casting material thus occupy only a negligible portion of a channel 44 adjacent to two sides, which channel opens upwards but also extends the entire way down into the cylindrical channel 45 which opens astern and forms a space for the propeller shaft 24 and its bearings. In casting, the core of the channel 45 forms a support for the long core in the channel 44 which runs downwards under the transverse channel 48 with normal clearance so that the casting at the wall in the extension downwards of the channel 42 is somewhat thicker, as seen at 47, than in the other wall sections.

Opposite the middle channel 38 at the lower end of the housing opens a shorter cavity 40 whose upper, cylindrical section forms a bearing 41 box for a bearing to the shaft 20 with the angular drive 22. At the lower end opening of channel 40 the water pump 30 is provided, e.g. in the form of a simple centrifugal pump having an impeller which opens downwards, which immediately ejects abrasive particles which can accompany the inlet water and which, in common pump arrangements, can quickly wear out the pump. The intake of water to the pump 30 preferably takes place through a number of holes 31 through the casting behind the pump 30 where the risk of clogging or covering of the inlet holes by, for example, floating plastic foil or other refuse is smallest.

The lower end of the housing with channels 36 and 40 which open there is closed with the fin or skeg member 32 whose upper edge sealingly attaches to the lower edge of the housing. The fin member 32 is detachably mounted with bolts 25 threaded into the housing casting.

To ensure the supply of cooling water to the motor in the event of rupture of the fin 30 from a grounding, the water from the pressure side of the pump 30 is preferably led to the plastic tube 37 through a transition 33 whose walls comprise neither a part of the housing nor the fin. The inlet port from the holes 31 to the pump 30 can, on the other hand, be delimited by the casting material in the housing and the fin since a rupture there does not entail a corresponding danger.

In casting the housing, the cores in the cavity 40 and the channel 45 form supports for one another and the core in the cavity 40 forms additional support for the core in the channel 38. The three cores thus support and lock one another in exactly determined positions which increases precision in casting.

From the motor through the upper section of the channel 44 runs an exhaust connection piece 52 which has the form of a double-walled pipe. The piece 52 may, at its opening, have the support of a rubber block 53 which does not, however, fill the entire cross section between the connector piece 52 and the wall of the channel 44, but instead allows free passage for outflowing cooling water which is conveyed from the motor to the channel 44 around the connector piece 52 during the cooling of said piece.

Under the opening of the connector piece 52, cooling water and exhaust gas flow out through the channel 44 and the cylindrical channel 45 to the surrounding water behind the propeller 26.

In starting and idling the motor the back pressure of the surrounding water is unsuitably high for exhaust discharge through the propeller 26. The housing 10 therefore has an additional channel 46 which partly surrounds the upper portion of the channel 44. Holes through the inner and outer wall of the channel 46 permit passage of exhaust gas from the channel 44 to the surrounding air when the back pressure in the lower portion of the channel 44 is too great.

On the outer wall of the channels 46 and 38 there are provided attachment lugs 54, 55 through which bolts attach the housing 10 at the motor.

In addition there is on the housing a cavitation plate 56 facing astern and located at such distance from the propeller center that the propeller 26 has sufficient clearance from the plate 56. The plate 56 is stiffened in the normal manner with a vertical, thin member which attaches to the back or trailing edge 57 of the housing 10.

What I claim is:

1. In an outboard drive for a boat, an upright unitary die cast housing leg member having an upper end, a lower end, a leading edge and a trailing edge, said member comprising intregral interior walls including walls defining an upright drive shaft cavity and a separate upright exhaust gas cavity, each said cavity opening through said upper end, said drive shaft cavity being terminated downwardly by a lower end wall portion, said lower end wall portion being apertured alignedly with said upright cavity to provide a drive shaft opening therethrough, said drive shaft cavity tapering downwardly toward said lower end wall portion, and further walls defining a gear cavity disposed below said end wall portion and aligned with said aperture, and further walls defining a generally horizontal propeller shaft cavity opening forwardly into said gear cavity and opening rearwardly through said trailing edge, said exhaust gas cavity opening downwardly into said propeller shaft cavity, said member having a downward lower end opening providing upward access into said gear cavity, and a closure member detachably attached to said lower end of said housing member in covering relation to said lower end opening.

2. The combination according to claim 1 wherein a motor is attached directly to said upper end of said housing member.

3. The combination according to claim 1 wherein said integral interior walls further include walls defining an upwardly tapered upright cooling water cavity disposed between said drive shaft cavity and said leading edge, and further walls defining a transverse cooling water channel extending generally fore and aft along one side of said housing member and having a forward end adjacent said leading edge, said cooling water cavity opening upwardly into said forward end of said channel.

4. The combination according to claim 3 in which said integral interior walls further include walls defining a downwardly tapering upper cooling water cavity disposed rearwardly of said drive shaft cavity and having a lower end opening into said channel spacedly rearwardly of said forward end thereof and an upper end opening through said upper end of said leg member.

5. The combination according to claim 3 wherein said leg member further comprises means defining an inlet cooling water chamber between said gear cavity and said closure member and wherein said cooling water cavity opens spacedly below said channel into said inlet chamber.

6. The combination according to claim 5 wherein said means comprises a cooling water pump having an inlet communicating with the interior of said chamber and an outlet communicating into said cooling water cavity.

7. The combination according to claim 6 wherein a pipe is provided from the outlet of said pump through said cooling water cavity to and opening into said transverse channel.

8. In an outboard drive for a boat, an upright unitary die cast housing leg member having an upper end, a lower end, a leading edge and a trailing edge, said member comprising integral interior walls including walls defining an upright drive shaft cavity, said cavity opening through said upper end and terminated downwardly by a lower end wall portion, said lower end wall portion being apertured alignedly with said upright cavity to provide a drive shaft opening therethrough, said upright cavity tapering downwardly toward said lower end wall portion, and further walls defining a gear cavity disposed below said end wall portion and aligned with said aperture, and further walls defining a generally horizontal propeller shaft cavity opening forwardly into said gear cavity and opening rearwardly through said trailing edge, said member having a downward lower end opening providing upward access into said gear cavity, and a closure member detachably attached to said lower end of said housing member in covering relation to said lower end opening, said integral interior walls further including an apertured bottom wall for said gear cavity disposed spacedly above said closure member, a water pump closing the aperture in said bottom wall and, with said bottom wall and said closure member, defining a water chamber for supplying water to said pump, said closure member being provided with water inlet openings to admit water from outside of said leg member into said water chamber.

9. In an outboard drive for a boat, an upright unitary die cast housing leg member having an upper end, lower end, a leading edge and a trailing edge, said member comprising integral interior walls including walls defining an upright drive shaft cavity, said cavity opening through said upper end and terminated downwardly by a lower end wall portion, said lower end wall portion being apertured alignedly with said upright cavity to provide a drive shaft opening therethrough, said upright cavity tapering downwardly toward said lower end wall portion, and further walls defining a gear cavity disposed below said end wall portion and aligned with said aperture, and further walls defining a generally horizontal propeller shaft cavity opening forwardly into said gear cavity and opening rearwardly through said trailing edge, said integral interior walls further including walls defining an upwardly tapered upright cooling water cavity disposed between said drive shaft cavity and said leading edge and having an opening for admitting cooling water into said water cavity and further walls defining a transverse cooling water channel extending generally fore and aft along one side of said housing member and having a forward end adjacent said leading edge, said forward end of said channel opening into said cooling water channel spacedly above said cooling water admitting opening, said member having a downward lower end opening providing upward access into said gear cavity, and a closure member detachably attached to said lower end of said housing member in covering relation to said lower end opening.

10. The combination according to claim 9 wherein a cooling water chamber is defined between said gear cavity and said closure member, said chamber and said water cavity being in communication through said water admitting opening.

11. The combination according to claim 10 wherein said closure member is provided with an intake opening for receiving water from outside of said leg member into said chamber and wherein a cooling water pump is disposed in said admitting opening.

12. In an outboard drive for a boat, an upright unitary die cast housing leg member having an upper end, a lower end, a leading edge and a trailing edge, said member comprising integral interior walls including walls defining an upright drive shaft cavity and a separate upright exhaust gas cavity disposed rearwardly of said drive shaft cavity, each said cavity opening through said upper end, and further walls defining a gear cavity disposed alignedly below and opening into said drive shaft cavity, and further walls defining a generally horizontal propeller shaft cavity rearwardly of and opening forwardly into said gear cavity and opening rearwardly through said trailing edge, said exhaust gas cavity opening downwardly into said propeller shaft cavity, and further walls defining an upright cooling water cavity having an upper end and a lower end and being disposed forwardly of said drive shaft cavity and inwardly along said leading edge of said leg member, and further walls defining a transverse cooling water channel extending generally fore and aft along one side of said housing member and having a forward end adjacent said leading edge opening into said cooling water cavity above said lower end thereof.

* * * * *